US005965485A

United States Patent [19]

Mizumachi et al.

[11] Patent Number: 5,965,485

[45] Date of Patent: Oct. 12, 1999

[54] IMAGE-TRANSFER INK RIBBON, IMAGE-TRANSFERRED MEMBER AND METHOD FOR PRODUCING THE IMAGE-TRANSFERRED MEMBER

[75] Inventors: Motohiro Mizumachi; Satoru Shinohara; Kenichi Saito, all of Miyagi, Japan

[73] Assignee: Sony Corporation, Tokyo, Japan

[21] Appl. No.: 08/825,927

[22] Filed: Apr. 2, 1997

[30] Foreign Application Priority Data

Apr. 5, 1996 [JP] Japan ..... 8-110214
Apr. 12, 1996 [JP] Japan ..... 8-091600

[51] Int. Cl.[6] ..... B41M 5/035; B41M 5/38

[52] U.S. Cl. ..... 503/227; 428/195; 428/331; 428/423.1; 428/480; 428/500; 428/522; 428/536; 428/913; 428/914

[58] Field of Search ..... 8/471; 428/195, 428/484, 488.1, 488.4, 913, 914, 331, 423.1, 473.5, 480, 500, 522, 536; 503/227

[56] References Cited

U.S. PATENT DOCUMENTS 4,558,329 12/1985 Honda ..... 346/76 PH
5,175,139 12/1992 Nakamura et al. ..... 503/227

*Primary Examiner*—Bruce H. Hess
*Attorney, Agent, or Firm*—Hill & Simpson

[57] ABSTRACT

An image-transfer ink ribbon which is prevented from unsuitable coloring of an image-protective layer thereon is disclosed, which includes a base film, at least one ink layer formed on one surface of the base film, an image-protective layer formed on the one surface of the base film so as to be arranged on the same plane where the at least one ink layer is formed, and a resin layer made of a resin having a low dye affinity and formed on the image-protective layer. In accordance with the present invention, there are also disclosed an image-transferred member prepared by using the image-transfer ink ribbon, and a method for the production of the image-transferred member.

12 Claims, 4 Drawing Sheets

IMAGE-TRANSFER INK RIBBON, IMAGE-TRANSFERRED MEMBER AND METHOD FOR PRODUCING THE IMAGE-TRANSFERRED MEMBER

BACKGROUND OF THE INVENTION

The present invention relates to an image-transfer ink ribbon provided on the same surface of a base film with an ink layer adapted for transferring an ink image on a printing medium and an image-protective layer serving for forming a protecting layer for the ink image transferred on the printing medium. In addition, the present invention also relates to an image-transferred member produced by heat-transferring an ink image and an image-protective layer on a printing medium such as a printing paper, using the image-transfer ink ribbon.

Heat-transferring systems are known as one of methods for forming an image on a printing paper based on an image information prepared by personal computers or the like. Hitherto, the images formed on the printing paper, for example, those prepared by sublimation-type heat transfer system using sublimable or thermally-diffusible dyes, have been covered by laminating an image-protective layer made of a thermoplastic resin thereover to protect the dye image.

In this case, such an image-protective layer is required to have various functions or properties such as shielding of the images from gases which causes image deterioration, ultra-violet absorbing properties for preventing discoloration or fading of the image, a resistance to plasticizers for preventing the image-forming ink from migrating into various plasticizer-containing products such as erasers, abrasion properties, a resistance to sebum or the like. Further, it is required that the image-protective layer has, in addition to these image-protecting functions or properties, an aqueous ink-printing or stamping ability in order to provide substitutes for silver salt photographs such as photographs for certificates.

As methods for laminating the image-protective layer over the afore-mentioned image, there are known a method of thermocompression-bonding the image-protective layer on a surface of the printing medium on which the image to be protected is formed, by using heat rollers, a method of adhering the image-protective layer onto the surface of the printing medium on which the image to be protected is formed, at a normal temperature by using an adhesive, or the like. Also, there is known a method of preparing a transfer-type image-protective film composed of a base film and an image-protective layer laminated thereon, and heat-transferring the image protective layer on the image to be protected to laminate the image-protective layer over the image.

In the case where such a transfer-type image-protective film is used, since only portions of the image-protective layer thereon which are heated upon the heat-transferring are laminated over the image to be protected, the printing paper on which the image is formed is prevented from being curled after lamination of the image-protective layer. Further, in the case where an image-transfer ink ribbon having an ink layer and an image-protective layer on the same surface thereof, i.e., a so-called laminating film-integrated ink ribbon, is used, the formation of the ink image and the laminating of the image-protective layer can be performed sequentially and continuously within a heat-transfer printer.

Incidentally, in general, the process for the production of the afore-mentioned laminating film-integrated ink ribbon which has an ink layer and an image-protective layer on the same surface thereof, includes a first step of applying the ink layer and the image-protective layer on the base film and rolling up the resultant laminate, followed by cutting the rolled laminate to form an elongated ribbon having a width corresponding to that of a final product, and a second step of rewinding the thus-formed ribbon around ribbon spools.

In the afore-mentioned first rolling step, the ink layer formed on a front surface of the base film is caused to come into contact with a back coat layer formed on a back surface of the base film, so that a considerable amount of dyes contained in the ink layer is transferred to the back coat layer. Further, in the second rewinding step, the rolled layer is unrolled and rewound around the ribbon spools while sequentially changing a roll diameter thereof. This procedure causes the change in contact position between the ink layer and the back coat layer, so that there arises a phenomenon that the dyes transferred to the back coat layer from the ink layer in the first step is re-transferred to the image-protective layer when rewound in the second step.

For this reason, when the laminating film-integrated ink ribbon produced according to the afore-mentioned process is used for image-printing, there is a likelihood that the dyes re-transferred to the image-protective layer is color-developed when laminated on the image and therefore unsuitable coloring is caused by the developed dyes on the image-protective layer. These problems become more remarkable in media having a higher sensitivity.

In order to eliminate these problems, it has been attempted to shorten the process time from the application of the ink layer up to the rewinding of the ribbon. This attempt has been found to be successful in reducing a risk of the re-transferring of the dyes to some extent, but associated with difficulties in process control, scheduling and the like. Alternatively, it has also been attempted to reduce the risk of the re-transferring of the dyes by using, as a composition of the back coat layer, those which are unlikely to cause the dye transfer. However, the back coat layer is required to exhibit lubricating properties and therefore any lubricant is to be added to the back coat layer, thereby increasing a tendency of the dye transferring.

Whereas, in the afore-mentioned conventional heat-transfer system, the image-protective layer has been uniformly transferred to the printing medium within the printer by means of a predetermined function thereof, so that the transferred image-protective layer has exhibited a uniform surface condition. In these conventional image formation techniques, it has not been considered that the image-transferred member is subjected to surface treatments generally used in silver salt photographs, such as semi-gloss finish treatments or silk finish treatments. For these reasons, the conventional heat-transfer system has not necessarily been suitable for general photograph applications to a sufficient extent.

SUMMARY OF THE INVENTION

Accordingly, it is an object of the present invention to provide an image-transfer ink ribbon which can prevent dyes transferred from an ink layer to a back coat layer from re-transferring to an image-protective layer, and therefore can prevent an image on a printing medium from being unsuitably colored upon laminating.

It is another object of the present invention to provide a image-transferred member, which is excellent in color reproducibility, using the afore-mentioned image-transfer ink ribbon.

It is a further object of the present invention to provide a image-transferred member, which can exhibit a suitability for various surface treatments as used for silver salt photographs, when the image-protective layer is laminated on the ink image by a heat transfer method, whereby the user can attain optional surface conditions thereof, and a method for producing such an image-transferred member.

The image-transfer ink ribbon according to the present invention includes a base film, and at least one ink layer and an image-protective layer both formed on the base film. The at least one ink layer and the image protective layer are arranged in rows on the same surface of the base film. Further, a resin layer having a low dye affinity is formed on a surface of the image-protective layer.

The thickness of the afore-mentioned resin layer having a low dye affinity is preferably in the range of 0.3 to 2.0 $\mu$m. When the thickness of the resin layer having a low dye affinity is less than 0.3 $\mu$m, the effects of the low dye affinity of the resin layer are apt to be decreased. On the other hand, when the thickness of the resin layer having a low dye affinity is more than 2.0 $\mu$m, the adhesion between the image-protective layer and the printing medium for receiving the transferred ink image is deteriorated.

In the image-transfer ink ribbon according to the present invention, since the resin layer having a low dye affinity is laminated over the image-protective layer, the dyes transferred from the ink layer to the back coat layer can be prevented from re-transferring to the image-protective layer or the resin layer having a low dye affinity during the process for the production of the image-transfer ink ribbon, whereby the image formed on a printing medium can be prevented from being unsuitable colored by the re-transferred dyes.

Further, the image-transferred member, which is produced by using the afore-mentioned image-transfer ink ribbon, has such a structure that the ink image formed on a printing paper are covered with the image-protective layer, and the resin layer having a low dye affinity is formed on a surface of the image-protective layer such that the resin layer having a low dye affinity is brought into contact with the ink image.

In the image-transferred member according to the preferred embodiment of the present invention, since the ink image formed on the printing medium is covered with the image-protective layer having the resin layer having a low dye affinity, the image-protective layer is prevented from being unsuitably colored, so that the image-transferred member according to the present invention can exhibit an excellent color reproducibility.

In addition, in the image-transferred member according to another preferred embodiment of the present invention, the ink image is formed on the printing paper by a heat-transfer method, and covered with the afore-mentioned image-protective layer. The image-transferred member according to this embodiment is characterized in that the image-protective layer is formed on the transferred image by selectively heating an image-protective layer on a transfer medium such as ink ribbons and thereby heat-transferring the selectively-heated portion thereof onto the printing paper.

In the image-transferred member according to this embodiment, the ink image is covered with the image-protective layer having, for example, predetermined irregular patterns formed by the selective heat-transferring, so that the image-transferred member can be subjected to various surface treatments as used in the field of silver salt photographs by using appropriate heating patterns or the like, whereby the user can attain an image-transferred member having optional surface conditions.

Further, the method for producing the image-transferred member according to the present invention is characterized by the steps of forming an ink image on a printing paper by a heat-transferring method, and thereafter selectively heating an image-protective layer to be transferred to heat-transfer the layer on the printing paper, so that the ink image can be covered by the transferred image-protective layer.

In accordance with such a method of producing the image-transferred member according to the present invention, since the image-protective layer is selectively heat-transferred, portions of the image-protective layer, which are heated upon the heat-transferring and laminated on the transferred image, are caused to have different surface conditions from those of non-heated remaining portions. This makes it possible to impart, for example, given irregular patterns to the surface of the transferred image-protective layer, whereby the resultant image-transferred member can be subjected to various surface treatments as conducted in conventional silver salt photographs and therefore the user can prepare optional surface conditions thereof.

DETAILED DESCRIPTION OF THE PREFERRED EMBODIMENT

First, the heat transfer-type image-recording material, i.e., a so-called laminating film-integrated ink ribbon, in accordance with the present invention, is described in detail below by referring to the accompanying drawings.

Figure 1:
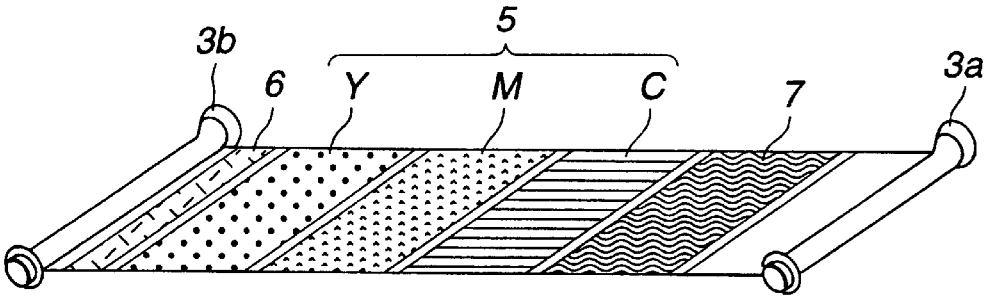
FIG. 1 is a perspective view showing one embodiment of a laminating film-integrated ink ribbon in accordance with the present invention.
Figure 2A:
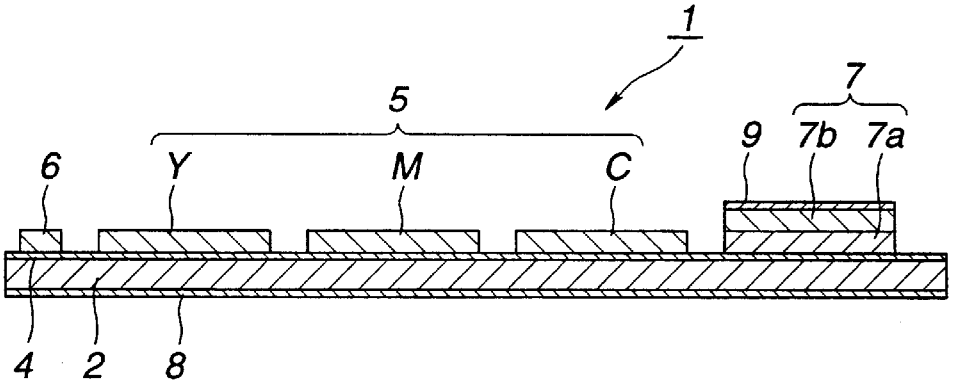
FIGS. 2A and 2B are cross-sectional and plan views, respectively, showing an essential part of the laminating film-integrated ink ribbon of FIG. 1.
Figure 2B:
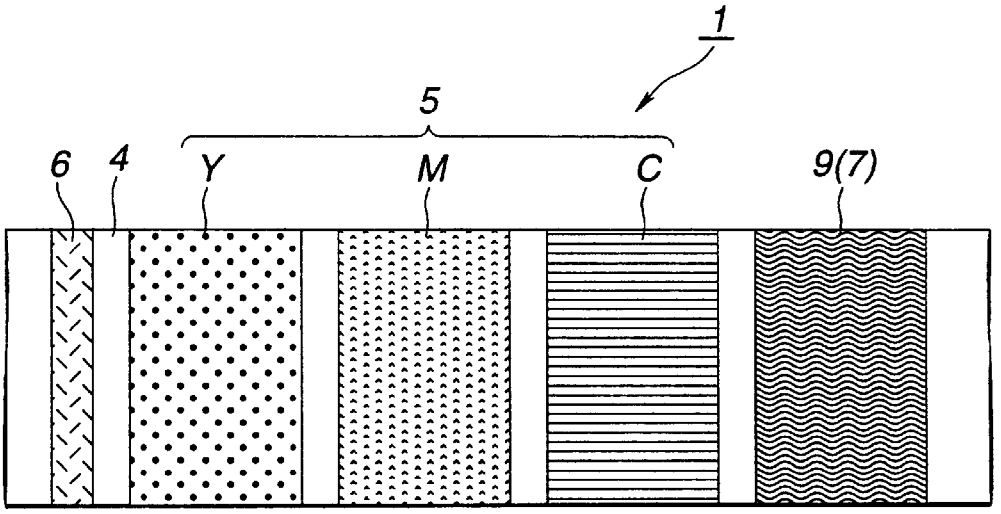

The laminating film-integrated ink ribbon 1 to which the present invention is applied, is used, for example, in such a manner that opposite ends of a base film 2 thereof is wound around a pair of ribbon spools 3*a* and 3*b*, as shown in FIG. 1. As shown in FIG. 1 and FIGS. 2A and 2B, the laminating film-integrated ink ribbon 1 is formed on a front surface thereof with a primer layer 4. An ink layer 5 composed of three color segment layers, i.e., yellow Y, magenta M and cyan C, a sensor mark 6 and an image-protective layer 7 in turn are arranged in rows on one surface of the primer layer 4, i.e., on the same plane. On the other hand, a heat-resistant lubricating layer 8 as a back coat layer is formed on the opposite back surface of the base film 2. The afore-mentioned image-protective layer 7 is constituted by a releasable protective layer 7*a* and an adhesive layer 7*b*. Further, a resin layer 9 made of a resin having a low dye affinity is formed on the image-protective layer 7. The resin layer 9 having a low dye affinity on the front surface is brought into contact with the heat-resistant lubricating layer 8 on the back surface while the laminating film-integrated ink ribbon 1 is wound into a small roll.

The afore-mentioned primer layer 4 is provided to enhance the adhesion between the base film 2 and the ink layer 5. The heat-resistant lubricating layer 8 formed on the back surface of the base film serves to prevent the base film 2 from being fused with a thermal head of a printer when the ink image and the image-protective layer 7 are formed by a heat transfer-type printer, thereby ensuring a smooth traveling of the laminating film-integrated ink ribbon 1. The afore-mentioned image-protective layer 7 serves to protect the transferred ink image when transferred onto the ink image, thereby providing substitutes for silver salt photographs. The releasable protective layer 7*a* of the image-protective layer 7 has functions of improvement in releasability thereof from the base film when transferred, and image protection. However, the releasable protective layer 7*a* is not essential and therefore can be omitted.

The resin layer 9 having a low dye affinity formed on the image-protective layer 7 is brought into contact with dyes transferred from the ink layer 5 to the back coat layer 8 in the preceding rolling step, when the laminating film-integrated ink ribbon 1 is rewound on the ribbon spools. Even in such as case, since the resin layer 9 has a low dye affinity, the dyes transferred from the ink layer 5 in the preceding rolling step are prevented from re-transferring to the resin layer 9. This prevents the image-protective layer 7 of the laminating layer-integrated ink ribbon 1 from being unsuitably colored upon laminating.

The thickness of the resin layer 9 having a low dye affinity and formed on the adhesive layer 7*b* is preferably in the range of 0.3 to 2.0 $\mu$m. When the thickness of the resin layer 9 having a low dye affinity is less than 0.3 $\mu$m, the resin layer 9 is partially mixed with the adhesive layer 7*b* when applied to the adhesive layer 7*b*, so that the effects of the low dye affinity of the resin layer 9 is apt to be deteriorated. On the other hand, when the thickness of the resin layer 9 having a low dye affinity is more than 2.0 $\mu$m, the adhesion between the image-protective layer 7 and the printing medium as an image-receiving medium is deteriorated. That is, when the image-protective layer 7 is heat-transferred to the printing medium, it is considered that the resin layer 9 having a low dye affinity, the adhesive layer 7*b* and a dye-receptor layer of the printing medium are mixed together by heat and pressure applied by the thermal head, so that the image-protective layer 9 and the printing medium can be adhered to each other. However, since many of resin materials constituting the resin layer 9 having a low dye affinity have low adhesion properties, if the thickness of the resin layer 9 is more than 2.0 $\mu$m, it is deemed to be difficult to adhere the image-protective layer 7 to the printing medium.

The afore-mentioned image-transferred member produced using the laminating film-integrated ink ribbon, is constituted by the printing paper on which a transferred ink image is formed, and an image-protective layer 7 covering the ink image. Further, the resin layer 9 having a low dye affinity is provided on a surface of the image-protective layer 7, which faces to and is brought into contact with the ink image.

As described above, in the process for the production of the laminating film-integrated ink ribbon, the resin layer 9 having a low dye affinity serves to prevent the dye of the ink layer 5 from re-transferring. Accordingly, the image-transferred member according to the present invention in which the transferred ink image is covered with the image-protective layer 7 formed with the resin layer 9 having a low dye affinity, is free from unsuitable coloring of the image-protective layer and can exhibit an excellent color reproducibility.

As the base films 2 of the image-transferred member according to the present invention, there can be used the same substrates as those used in conventional ink ribbons. However, there can also be used the other kinds of substrates without any particular limitations. Examples of these substrates may include polyester films, polyimide films or the like. The thickness of the base film is suitably in the range of 3 to 20 $\mu$m.

The material of the primer layer 4 may be appropriately selected depending upon kinds of resin materials used for the base film 2 or the ink layer 5. Examples of the suitable materials for the primer layer 4 may include urethane-based resins, acrylic resins, polyester-based resins or the like.

The ink layer 5 may be formed from, for example, cellulose-based resins such as methyl cellulose, ethyl cellulose, ethylhydroxy-ethyl cellulose, hydroxy-propyl cellulose, cellulose acetate butyrate or cellulose acetate, vinyl-based resins such as polyvinyl alcohol, polyvinyl butyral, polyvinyl acetoacetal, polyvinyl acetate or polystyrene, or various other resins such as polyester-based resins, acrylic resins, urethane-based resins or the like.

The heat-resistant lubricating layer 8 may be formed from resins having a high softening point, such as cellulose acetate-based resins, polyvinyl butyral-based resins or the like. Further, the heat-resistant lubricating layer 8 may contain lubricants such as silicone oil, waxes, fatty acids or phosphates, and organic or inorganic fillers, if required.

The releasable protective layer 7*a* may be formed from thermoplastic resins such as acrylic resins, cellulose ester-based resins, polyvinyl butyral-based resins or the like. In addition, in order to enhance the releasability, the releasable protective layer 7*a* may contain release agents such as silicone oil, fluorine-based surface active agents or the like. Further, the releasable protective layer 7*a* may contain various surface active agents such as cationic surface active agents such as quaternary ammonium salts, polyamines or the like, anionic surface active agents such as alkylbenzene sulfonates, alkyl sulfuric acid ester-sodium salts or the like, amphoteric surface active agents, nonionic surface active agents or the like, in order to impart an anti-static property thereto.

The adhesive layer 7*b* may be formed from thermoplastic resins such as polyester-based resins, cellulose ester-based resins, vinyl chloride-vinyl acetate copolymer-based resins, urethane-based resins, ethylene-vinyl acetate copolymer-based resins or the like. Incidentally, when the resin for the adhesive layer 7*b* is selected, it is necessary to ensure that the image-forming dye is avoided from oozing out through the resin.

The resin layer 9 having a low dye affinity may be formed from acrylic resins, polyvinyl alkyl acetal-based resins, acetyl cellulose-based resins, styrene-based resins or the like.

In order to improve a keeping quality of the ink image, the releasable protective layer 7*a*, the adhesive layer 7*b* and the resin layer 9 having a low dye affinity may contain additives such as ultraviolet absorbers, light stabilizers, anti-oxidizing agents or the like, if required. Examples of the ultraviolet absorbers may include salicylic acid derivatives, benzophenone derivatives, benzotriazole derivatives, oxalic acid-anilide derivatives or the like. Examples of the light stabilizers may include hindered amine-based agents or the like. Examples of the anti-oxidizing agents may include hindered phenol-based agents, phosphite-based agents or the like. In addition to these additives, organic or inorganic fillers may be added to the afore-mentioned layers.

Figure 3:
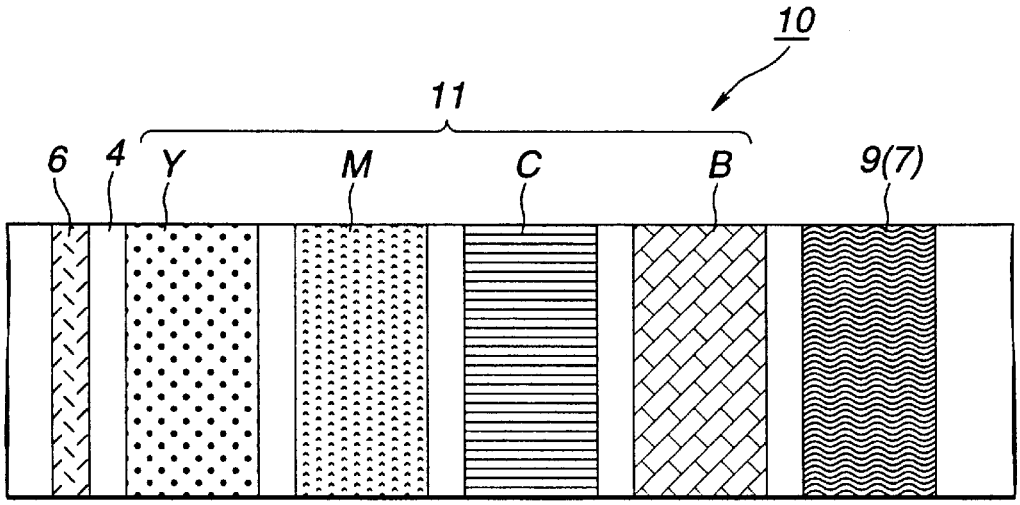
FIG. 3 is a plan view showing an essential part of another embodiment of a laminating film-integrated ink ribbon in accordance with the present invention.
Figure 4:
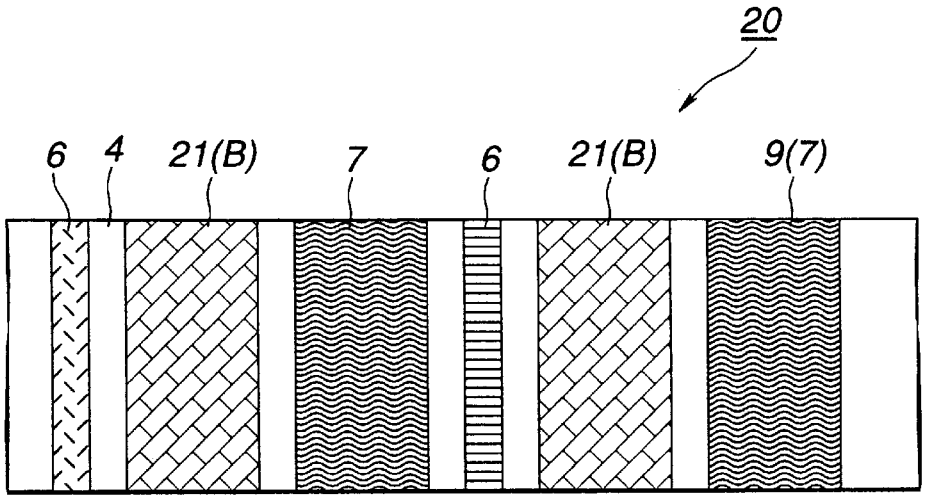
FIG. 4 is a plan view showing an essential part of a further embodiment of a laminating film-integrated ink ribbon in accordance with the present invention.

Further, the configuration of the laminating film-integrated ink ribbon according to the present invention is not limited to those illustrated in FIGS. 1 and 2. For example, as shown in FIG. 3, there can also be used a laminating film-integrated ink ribbon 10 which is provided with an ink layer 11 composed of four color segment layers, i.e., yellow Y, magenta M, cyan C and black B. Furthermore, as shown in FIG. 4, there can also be used a laminating film-integrated ink ribbon 20 which is provided with an ink layer 21 composed merely of one color segment layer, i.e., black B. Incidentally, throughout the present specification and the accompanying drawings, like reference numerals denote like or equivalent components or elements.

In addition, these laminating film-integrated ink ribbons can be produced according to normal methods. For example, the laminating film-integrated ink ribbon 1 can be formed by coating the heat-resistant lubricating layer 8, the primer layer 4, the ink layer 5, the releasable protective layer 7*a*, the adhesive layer 7*b* and the resin layer 9 having a low dye affinity in a in-line manner using a multi-head gravure coater.

The examples concerning the production of an image-recording material having a configuration of the afore-mentioned laminating layer-integrated ink ribbon 1 are described in detail below.

EXAMPLE 1

As a base film 2, a polyethylene terephthalate film having a thickness of 6 μm was used.

A coating material having the below-mentioned composition (a) was coated on one surface of the base film 2 by a gravure coater and cured at 50° C. for 120 hours to form a heat-resistant lubricating layer 8 having a dry thickness of 1 μm. In addition, a coating material having the below-mentioned composition (b) was coated on the other surface of the base film 2 by a gravure coater to form a primer layer 4 having a dry thickness of 0.1 μm. Further, coating materials for an ink layer 5 having below-mentioned compositions ($c_Y$), ($c_M$) and ($c_C$), respectively, were in turn coated on the primer layer 4 and then dried so as to form ink segment layers Y, M and C arranged in rows on the primer layer 4 along the longitudinal direction of the base film 2 and each having a dry thickness of 1 μm. Simultaneously, a coating material having the below-mentioned composition (d) was coated on the primer layer 4 and then dried to form an image-protective layer 7 arranged in rows relative to the ink layer 5 and having a dry thickness of 3 μm. Further, a coating material having the below-mentioned composition (e) was coated on the image-protective layer 7 and then dried to form a resin layer 9 having a low dye affinity and a dry thickness of 1.0 μm, so that a laminating film-integrated ink ribbon according to Example 1 was obtained.

| Composition (a): Coating material for heat-resistant lubricating layer 8: | |
|---|---|
| Polyvinyl butyrate (S-LEC-BX-55Z manufactured by Sekisui Chemical Industry Co., Ltd.) | 5.7 % by weight |
| Calcium carbonate (Hakuen-ka DD manufactured by Shiraishi Kogyo Co., Ltd.) | 0.6 % by weight |
| Phosphoric acid ester (PHOSPHANOL RD-720 manufactured by Toho Chemical Industry Co., Ltd.) | 0.6 % by weight |
| Phosphoric acid ester (PLYSURF A208S manufactured by Daiichi Kogyo Seiyaku Co., Ltd.) | 1.1 % by weight |
| Polyisocyanate (COLONATE L-45E manufactured by Nippon Polyurethane Industry Co., Ltd.) | 3.0 % by weight |
| Methyl ethyl ketone | 44.5 % by weight |
| Toluene | 44.5 % by weight |
| Composition (b): Coating material for primer layer 4: | |
| Polyurethane (NP-3151 manufactured by Nippon Polyurethane Industry Co., Ltd.) | 6.0 % by weight |
| Polyisocyanate (COLONATE L-45E manufactured by Nippon Polyurethane Industry Co., Ltd.) | 0.7 % by weight |
| Methyl ethyl ketone | 42.5 % by weight |
| Toluene | 42.5 % by weight |
| Cyclohexanone | 8.3 % by weight |
| Composition ($c_Y$): Coating material for yellow ink layer Y: | |
| Yellow dye (ESC Yellow-155 manufactured by Sumitomo Chemical Industry Co., Ltd.) | 5.0 % by weight |
| Butyral resin (DENKA Butyral 3000K manufactured by DENKI KAGAKU KOGYO Co.) | 5.0 % by weight |
| Methyl ethyl ketone | 45.0 % by weight |
| Toluene | 45.0 % by weight |
| Composition ($C_M$): Coating material for yellow ink layer M: | |
| Magenta dye (ESC Bordeaux-451 manufactured by Sumitomo Chemical Industry Co., Ltd.) | 2.5 % by weight |
| Magenta dye (BAYFAX VP SN2670 manufactured by Bayer Co., Ltd.) | 2.5 % by weight |
| Butyral resin (DENKA Butyral 3000K manufactured by DENKI KAGAKU KOGYO Co.) | 5.0 % by weight |
| Methyl ethyl ketone | 45.0 % by weight |
| Toluene | 45.0 % by weight |
| Composition ($c_C$): Coating material for cyan ink layer C: | |
| Cyan dye (Foron Brillianto Blue SR-PI manufactured by Sand Co. Ltd.) | 5.0 % by weight |
| Butyral resin (DENKA Butyral 3000K manufactured by DENKI KAGAKU KOGYO Co.) | 5.0 % by weight |
| Methyl ethyl ketone | 45.0 % by weight |
| Toluene | 45.0 % by weight |
| Composition (d): Coating material for image-protective layer 7: | |
| Cellulose acetate butyrate (CAB 551-0.01 manufactured by Eastman Chemical Co., Ltd.) | 16.0 % by weight |
| Cellulose acetate butyrate (CAB 500-5 manufactured by Eastman Chemical Co., Ltd.) | 4.0 % by weight |
| Methyl ethyl ketone | 40.0 % by weight |
| Toluene | 40.0 % by weight |
| Composition (e): Coating material for resin layer 9 having a low dye affinity: | |
| Acrylic resin (DELPOWDER manufactured by Asahi Kasei kogyo Co., Ltd.) | 9.4 % by weight |
| Silica (Nipsel B200A manufactured by Nippon Silica Co., Ltd.) | 0.6 % by weight |
| Methyl ethyl ketone | 45.0 % by weight |
| Toluene | 45.0 % by weight |

On the other hand, a printing paper was produced in the following manner. A polypropylene-based synthetic paper YUPO FPG-80 (manufactured by Ohji Yuka Synthetic Paper Co., Ltd.) having a thickness of 80 μm, a coated paper having a basis weight of 104 g/m$^3$ and YUPO PEARL (manufactured by Ohji Yuka Synthetic Paper Co., Ltd.) having a thickness of 75 μm were bonded to each other by using a polyester-based adhesive to form a three-layer laminated paper. A coating material having the below-mentioned composition (f) was coated on a YUPO PEARL- -side surface of the laminated paper and then dried to form an ink receptor layer having a dry thickness of 8 μm.

| Composition (f): Coating material for ink receptor layer: | |
|---|---|
| Cellulose acetate butyrate (CAB 551-0.01 manufactured by Eastman Chemical Co., Ltd.) | 10.0 % by weight |
| Cellulose acetate butyrate (CAB 500-5 manufactured by Eastman Chemical Co., Ltd.) | 10.0 % by weight |
| Silicone oil (SF 8427 manufactured by Toray Dow Corning Silicone Co., Ltd.) | 0.5 % by weight |
| Dicyclohexyl phthalate | 4.0 % by weight |
| Polyisocyanate (COLONATE L-45E manufactured by Nippon Polyurethane Industry Co., Ltd.) | 0.5 % by weight |
| Methyl ethyl ketone | 37.5 % by weight |
| Toluene | 37.5 % by weight |

EXAMPLE 2

The same procedure as described in Example 1 was repeated except that the resin layer 9 having a low dye affinity and formed from the coating material having the composition (e) had a dry thickness of 0.4 μm, so that a laminating film-integrated ink ribbon of Example 2 was obtained. The printing paper was also produced in the same manner as described in Example 1.

EXAMPLE 3

The same procedure as described in Example 1 was repeated except that the resin layer 9 having a low dye affinity and formed from the coating material having the composition (e) had a dry thickness of 1.8 μm, so that a laminating film-integrated ink ribbon of Example 3 was obtained. The printing paper was also produced in the same manner as described in Example 1.

EXAMPLE 4

The same procedure as described in Example 1 was repeated except that a coating material having the below-mentioned composition (g) was used to prepare the resin layer 9 having a low dye affinity, so that a laminating film-integrated ink ribbon of Example 4 was obtained. The printing paper was also produced in the same manner as described in Example 1.

| Composition (g): Coating material for resin layer 9 having a low dye affinity: | |
|---|---|
| Polyvinyl acetoacetal resin (DENKA Butyral 6000AS manufactured by DENKI KAGAKU KOGYO Co.) | 4.8 % by weight |
| Silica (Nipsel E200A manufactured by Nippon Silica Co., Ltd.) | 0.2 % by weight |
| Methyl ethyl ketone | 47.5 % by weight |
| Toluene | 47.5 % by weight |

EXAMPLE 5

The same procedure as described in Example 1 was repeated except that a coating material having the below-mentioned composition (h) was used to prepare the resin layer 9 having a low dye affinity, so that a laminating film-integrated ink ribbon of Example 5 was obtained. The printing paper was also produced in the same manner as described in Example 1.

| Composition (h): Coating material for resin layer 9 having a low dye affinity: | |
|---|---|
| Cellulose acetate resin (CA 398-3 manufactured by Eastman Chemical Co., Ltd.) | 4.8 % by weight |
| Silica (Nipsel E200A manufactured by Nippon Silica Co., Ltd.) | 0.2 % by weight |
| Methyl ethyl ketone | 47.5 % by weight |
| Toluene | 47.5 % by weight |

EXAMPLE 6

The same procedure as described in Example 1 was repeated except that a coating material having the below-mentioned composition (i) was used to prepare the resin layer 9 having a low dye affinity, so that a laminating film-integrated ink ribbon of Example 6 was obtained. The printing paper was also produced in the same manner as described in Example 1.

| Composition (i): Coating material for resin layer 9 having a low dye affinity: | |
|---|---|
| Polystyrene resin (DENKA Styrol QP-3 manufactured by DENKI KAGAKU KOGYO Co.) | 9.5 % by weight |
| Silica (Nipsel E200A manufactured by Nippon Silica Co., Ltd.) | 0.5 % by weight |
| Methyl ethyl ketone | 45.0 % by weight |
| Toluene | 45.0 % by weight |

EXAMPLE 7

The same procedure as described in Example 1 was repeated except that a coating material having the below-mentioned composition (j) was used to prepare the resin layer 9 having a low dye affinity, so that a laminating film-integrated ink ribbon of Example 7 was obtained. The printing paper was also produced in the same manner as described in Example 1.

| Composition (j): Coating material for resin layer 9 having a low dye affinity: | |
|---|---|
| Acrylonitrile styrene resin (STYLACK AT15 manufactured by Asahi Kasei Kogyo Co., Ltd.) | 9.5 % by weight |
| Silica (Nipsel E200A manufactured by Nippon Silica Co., Ltd.) | 0.5 % by weight |
| Methyl ethyl ketone | 45.0 % by weight |
| Toluene | 45.0 % by weight |

EXAMPLE 8

The same procedure as described in Example 1 was repeated except that a coating material having the below-mentioned composition (k) was used to prepare the resin layer 9 having a low dye affinity, so that a laminating film-integrated ink ribbon of Example 8 was obtained. The printing paper was also produced in the same manner as described in Example 1.

| Composition (k): Coating material for resin layer 9 having a low dye affinity: | |
|---|---|
| Acrylic resin (LM-406 manufactured by Fujikura Kasei Co., Ltd.) | 23.5 % by weight |

-continued

| | |
|---|---|
| Silica (Nipsel E200A manufactured by Nippon Silica Kogyo Co., Ltd.) | 0.5 % by weight |
| Methyl ethyl ketone | 38.0 % by weight |
| Toluene | 38.0 % by weight |

EXAMPLE 9

The same procedure as described in Example 1 was repeated except that a coating material having the below-mentioned composition (1) was used to prepare the resin layer 9 having a low dye affinity, so that a laminating film-integrated ink ribbon of Example 9 was obtained. The printing paper was also produced in the same manner as described in Example 1.

| Composition (l): Coating material for resin layer 9 having a low dye affinity: | |
|---|---|
| Polyvinyl butyral resin (S-LEC BX-55Z manufactured by Sekisui Chemical Industry Co., Ltd.) | 4.8 % by weight |
| Silica (Nipsel E200A manufactured by Nippon Silica Co., Ltd.) | 0.2 % by weight |
| Methyl ethyl ketone | 47.5 % by weight |
| Toluene | 47.5 % by weight |

EXAMPLE 10

The heat-resistant lubricating layer 8, the primer layer 4 and the ink layer 5 were formed on the base film 2 in the same manner as described in Example 1. Successively, coating materials having the below-mentioned compositions (m) and (n) were applied on the base film 2 to form an image-protective layer 7 composed of a releasable protective layer 7*a* and an adhesive layer 7*b*, respectively. Further, the coating material having the above-mentioned composition (e) was applied on the adhesive layer 7*b* to form a resin layer 9 having a low dye affinity, so that a laminating film-integrated ink ribbon of Example 10 was obtained. Separately, the printing paper was prepared in the same manner as described in Example 1 except that a coating material having the below-mentioned composition (o) was further applied thereonto to form a dye receptor layer thereon.

| Composition (m): Coating material for releasable protective layer 7a: | |
|---|---|
| Cellulose acetate butyrate (CAB 551-0.01 manufactured by Eastman Chemical Co., Ltd.) | 9.7 % by weight |
| Cellulose acetate butyrate (CAB 500-5 manufactured by Eastman Chemical Co., Ltd.) | 9.7 % by weight |
| Ultraviolet absorber (SEESORB manufactured by SHIPRO KASEI KAISHA, LTD) | 0.6 % by weight |
| Methyl ethyl ketone | 40.0 % by weight |
| Toluene | 40.0 % by weight |
| Composition (n): Coating material for adhesive layer 7b: | |
| Vinyl chloride-vinyl acetate copolymer (DENKA Vinyl #1000D manufactured by DENKI KAGAKU KOGYO Co.) | 20.0 % by weight |
| Methyl ethyl ketone | 40.0 % by weight |
| Toluene | 40.0 % by weight |
| Composition (o): Coating material for ink receptor layer: | |
| Vinyl chloride-vinyl acetate copolymer (DENKA Vinyl #1000AKT manufactured by DENKI KAGAKU KOGYO Co.) | 20.0 % by weight |

-continued

| | |
|---|---|
| Silicone oil (SF 8427 manufactured by Toray Dow Corning Silicone Co., Ltd.) | 0.5 % by weight |
| Dicyclohexyl phthalate | 4.0 % by weight |
| Polyisocyanate (COLONATE L-45E manufactured by Nippon Polyurethane Industry Co., Ltd.) | 0.5 % by weight |
| Methyl ethyl ketone | 37.5 % by weight |
| Toluene | 37.5 % by weight |

COMPARATIVE EXAMPLE 1

The same procedure as described in Example 1 was repeated except that no resin layer 9 having a low dye affinity was provided, so that a laminating film-integrated ink ribbon of Comparative Example 1 was obtained. The printing paper was also prepared in the same manner as described in Example 1.

COMPARATIVE EXAMPLE 2

The same procedure as described in Example 1 was repeated except that the coating material having the above-mentioned composition (e) was used to prepare a resin layer 9 having a low dye affinity and a dry thickness of 0.2 $\mu$m, to obtain a laminating layer-integrated ink ribbon of Comparative Example 2. The printing paper was also prepared in the same manner as described in Example 1.

COMPARATIVE EXAMPLE 3

The same procedure as described in Example 1 was repeated except that the coating material having the above-mentioned composition (e) was used to prepare a resin layer 9 having a low dye affinity and a dry thickness of 2.5 $\mu$m, to obtain a laminating layer-integrated ink ribbon of Comparative Example 3. The printing paper was also prepared in the same manner as described in Example 1.

COMPARATIVE EXAMPLE 4

The same procedure as described in Example 1 was repeated except that no resin layer 9 having a low dye affinity was provided, to obtain a laminating layer-integrated ink ribbon of Comparative Example 4. The printing paper was also prepared in the same manner as described in Example 1.

These laminating film-integrated ink ribbons prepared in Examples 1 to 10 and Comparative Examples 1 to 4 were cut into elongated ribbons each having a width identical to that of a final product immediately after the respective coating materials were coated. The cut ribbons in the form of a pancake (length: 5,000 m) were allowed to stand at a normal temperature for one month. The thus-treated ink ribbons prepared in Examples 1 to 10 and Comparative Examples 1 to 4 were rewound around ribbon spools. By using these ink ribbons wound on the ribbon spools, transfer-accelerating tests were conducted at 50° C. for 48 hours.

More specifically, the above-prepared laminating film-integrated ink ribbons and printing papers were set in a color printer UP-D7000 manufactured by Sony Corp. The image protective layer 7 and the resin layer 9 having a low dye affinity were transferred from the ink ribbon onto a blank printing paper without transferring an ink image thereon to prepare a laminated member. The thus-prepared laminated member was examined for a degree of coloring on a surface thereof. The results are shown in Table 1 below. Incidentally, in Table 1, the results concerning the degree of coloring were classified into the following three ranks:

Mark "x": Re-transferring of the ink layer 5 occurred and the color difference (CD) between the re-transferred portions and the remaining non-transferred portions on the laminated member was not less than 2.0 (2.0≦CD);

Mark "Δ": The color difference is not less than 1.0 and less than 2.0 (1.0≦CD<2.0); and Mark "O": The color difference is less than 1.0 (CD<1.0).

TABLE 1

| Example No. | Composition of resin layer having low dye affinity | Thickness of resin layer having low dye affinity | Composition of printing paper | Degree of coloring |
|---|---|---|---|---|
| Example 1 | (e) | 1.0 | (f) | ○ |
| Example 2 | (e) | 0.4 | (f) | ○ |
| Example 3 | (e) | 1.8 | (f) | ○ |
| Example 4 | (g) | 1.0 | (f) | ○ |
| Example 5 | (h) | 1.0 | (f) | ○ |
| Example 6 | (i) | 1.0 | (f) | ○ |
| Example 7 | (j) | 1.0 | (f) | ○ |
| Example 8 | (k) | 1.0 | (f) | ○ |
| Example 9 | (l) | 1.0 | (f) | ○ |
| Example 10 | (e) | 1.0 | (o) | ○ |
| Comparative Example 1 | none | — | (f) | x |
| Comparative Example 2 | (e) | 0.2 | (f) | Δ |
| Comparative Example 3 | (e) | 2.5 | (f) | hard to transfer |
| Comparative Example 4 | none | — | (o) | x |

As is apparent from Table 1, in the case where the laminating film-integrated ink ribbons prepared in Examples 1 to 10, which were formed on the image-protective layer 7 with the resin layer 9 having a low dye affinity and a thickness of 0.3 to 2.0 μm, were used, it was found that the resultant image-transferred members were able to exhibit a good color reproducibility. That is, in the case where the resin layer 9 having a low dye affinity and a thickness of 0.3 to 2.0 μm is formed on the image-protective layer 7, the dye transferred from the ink layer 5 to the heat-resistant lubricating layer 9 during the first rolling process can be prevented from being re-transferred onto the image-protective layer 7 when rewound in the second process.

Accordingly, since the dye transferred to the back coat layer is prevented from re-transferring onto the image-protective layer 7 during the process for the production of laminating film-integrated ink ribbons, the image-transferred members produced by using such laminating film-integrated ink ribbons (of Examples 1 to 10) formed with the resin layer 9 having a low dye affinity, can exhibit an excellent color reproducibility.

On the other hand, in the case where the laminating film-integrated ink ribbon (Comparative Example 2) formed thereon with the resin layer having a low dye affinity but a thickness of 0.2 μm was used to prepare the image-transferred member, the effects of the resin layer 9 having a low dye affinity could not be exhibited to a sufficient extent. Further, in such a case, the dye was re-transferred onto the resin layer having a low dye affinity and the image-protective layer 7, thereby causing unsuitable coloring thereon. This leads to a deteriorated color reproducibility of the image-transferred member. In addition, in the case where the laminating film-integrated ink ribbon (Comparative Example 3) formed thereon with the resin layer having a low dye affinity but a thickness of 2.5 μm was used to prepare the image-trasnsferred member, it is difficult to laminate the image-protective layer 7 on the printing paper because of low adhesion between the resin layer 9 having a low dye affinity and the printing paper. Accordingly, it is preferred that the thickness of the resin layer having a low dye affinity be in the range of 0.3 to 2.0 μm.

Next, there are described preferred embodiments of the image-transferred member according to the present invention. Such an image-transferred member has an image-protective layer heat-transferred onto the ink image by selectively heating the image-protective layer to be transferred.

The image-transferred member includes a printing paper, an ink image heat-transferred on the printing paper and the image-protective layer heat-transferred thereon by selective heating to cover the ink image.

Figure 5:
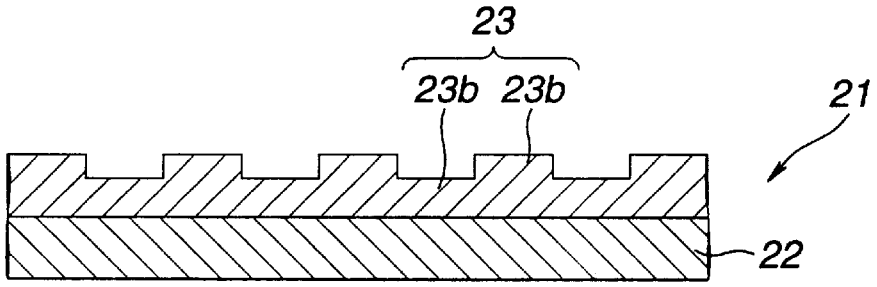
FIG. 5 is a cross-sectional view showing an essential part of one embodiment of an image-transferred member in accordance with the present invention.
Figure 6:
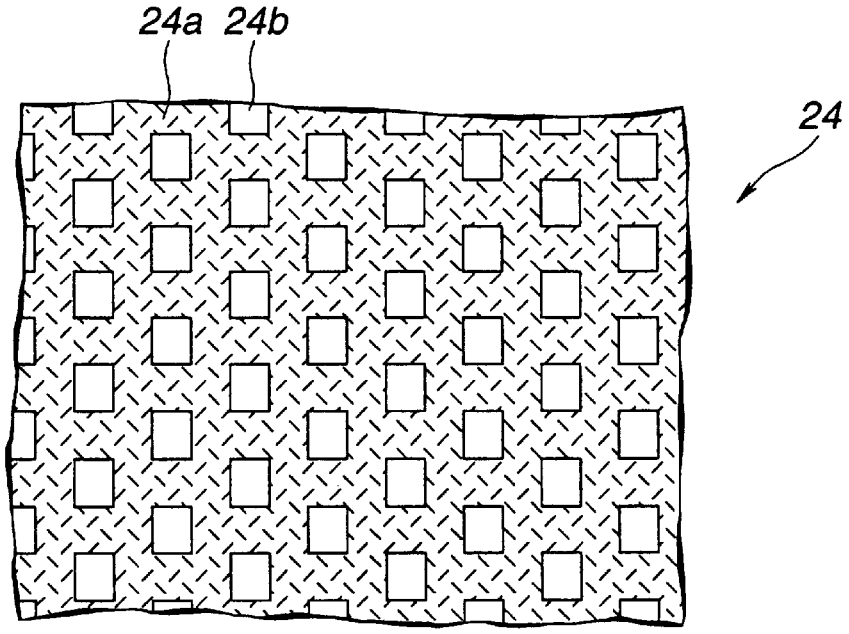
FIG. 6 is a view schematically showing a transfer pattern used for the production of the image-transferred member in accordance with the present invention.

For example, FIG. 5 shows a first preferred embodiment of an image-transferred member according to the present invention. The image-transferred member 21 has such a structure that an image-protective layer 23 having concave portions 23*a* and convex portions 23*b* is laminated over the printing paper on which the ink image is formed. Such a surface condition of the image-protective layer 23 is produced by selectively varying a degree of heating and fusing on respective portions of the image-protective layer to be transferred. For example, when a transfer pattern 24 as shown in FIG. 6 is used, the partially fused concave portions 23*a* are formed at portions corresponding to heating portions 24*a* of the transfer pattern 24 while the convex portions 23*b* are formed at portions corresponding to non-heating portions of the transfer pattern 24.

Figure 7:
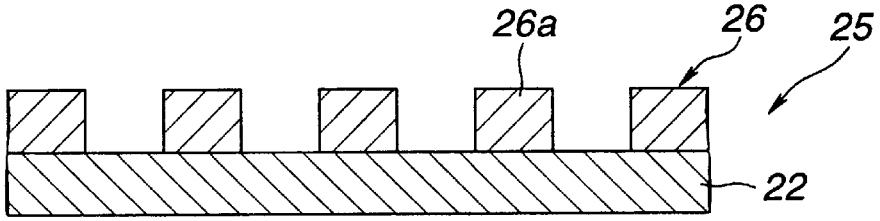
FIG. 7 is a cross-sectional view showing an essential part of another embodiment of an image-transferred member in accordance with the present invention.

FIG. 7 shows a second preferred embodiment of an image-transferred member according to the present invention. As shown in FIG. 7, the image-transferred member 25 may be provided with the image-protective layer 26 partially formed on the printing paper onto which the ink image is heat-transferred. In this case, the image-protective layer 26 is formed in such a manner that land portions 26*a* corresponding to the non-heating portions of the transfer pattern are separately distributed over the printing paper and the remaining portions corresponding to the heating portions of the transfer pattern are completely fused and eliminated therefrom.

Figure 8:
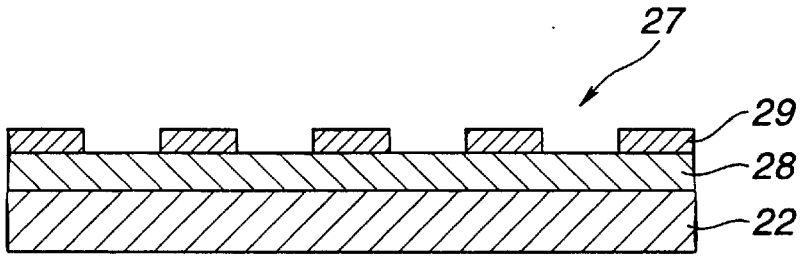
FIG. 8 is a cross-sectional view showing an essential part of a further embodiment of an image-transferred member in accordance with the present invention.

FIG. 8 shows a third preferred embodiment of an image-transferred member according to the present invention. As shown in FIG. 8, the image-transferred member 27 may have a composite structure in which a uniformly laminated lower image-protective layer 28 and land-shaped upper image-protective layer 29 are in turn formed on the printing paper having heat-transferred ink image thereon.

The afore-mentioned image-protective layers 21, 25 and 27 all are formed by selective heat-transferring. Surface conditions of these image-protective layers are appropriately selected according to the transfer pattern used. Thus, when fine irregularities or any other surface configurations are provided to vary surface conditions of the image-protective layers transferred, it is possible to accomplish a semi-gloss finish treatment due to change in reflectance of a surface of the image-protective layer. Alternatively, by using the transfer pattern having large irregularities, a so-called silk finish treatment can be accomplished.

The method for the production of the afore-mentioned image-transferred members, includes the steps of forming the ink image on the printing paper by heat-transferring; and then selectively heating an image-protective film to be transferred to form the image-protective layer covering the ink image. Further, as the method of selectively heating the image-protective layer to be heat-transferred, there can be suitably used a method of selectively heating the image-protective layer to be transferred, by controlling energizing and de-energizing of a thermal head.

Figure 9:
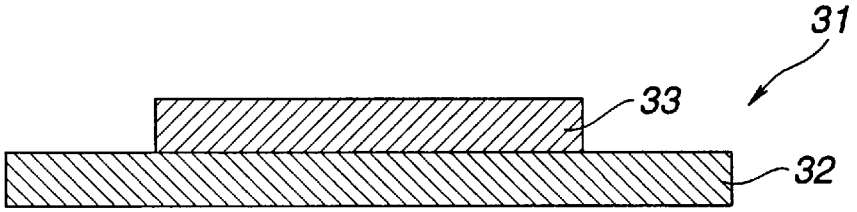
FIG. 9 is a cross-sectional view showing a transfer-type image-protective film.

For example, in the case where a transfer-type image-protective film 31 as shown in FIG. 9 is used to form a laminate over the ink image, an image-protective layer 33 is released from a base film 32 and heat-transferred on the ink image by using specific transfer patterns. The image-protective layer 33 before the heat-transferring has a uniform surface condition. Whereas, since the image-protective layer is selectively heat-transferred by using the specific transfer pattern as shown in FIG. 6, the image-protective layer 33 formed on the ink image after the heat-transferring can have various optional surface conditions, for example, as shown in FIGS. 5, 7 and 8. Incidentally, the transfer pattern can be implemented by the thermal head for the heat-transferring of the image-protective layer in a manner similar to the image data for the transferring of the ink image.

Figure 10A:
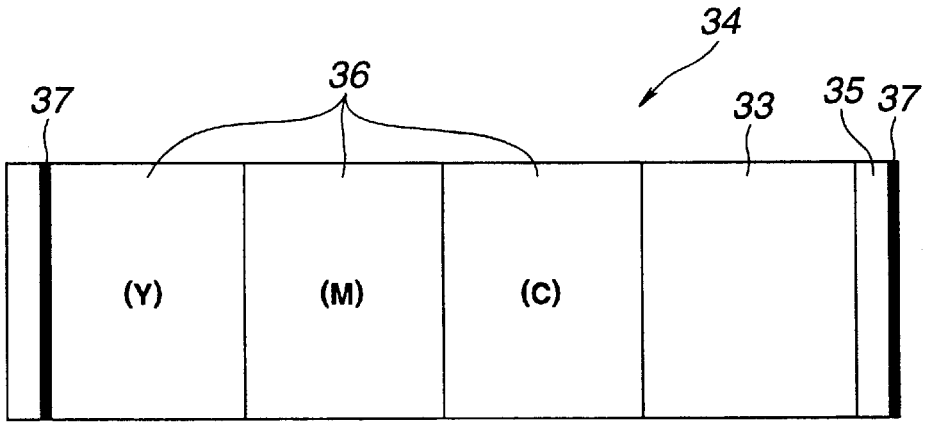
FIGS. 10A and 10B are plan and cross-sectional views, respectively, showing an essential part of a still further embodiment of a laminating film-integrated ink ribbon in accordance with the present invention, which is adapted for performing sequentially and continuously the transferring of the ink image and the image-protective layer.
Figure 10B:
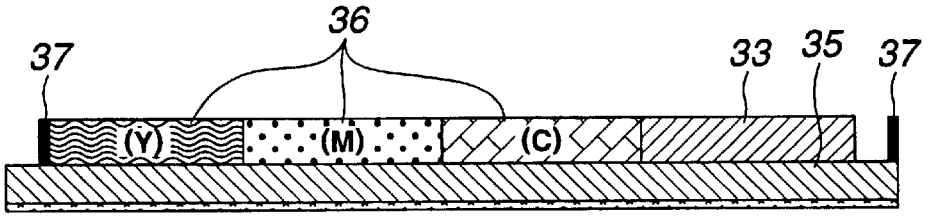

At this time, if the image-protective film 31 is constituted as a part of an ink ribbon, the transferring of the ink image and the image-protective layer 33 can be performed sequentially and continuously. Specifically, for example, in an ink ribbon 34 as shown in FIGS. 10A and 10B, an ink layer 36 composed of a yellow segment layer Y, a magenta segment layer M and a cyan segment layer C and a sensor mark 37 in turn are arranged in rows on the same surface of a base film 35. Further, the image-protective layer 33 is arranged in line on the same surface on which the ink layer and the sensor mark are formed.

In the case where the heat-transferring of the ink image and the image-protective layer is performed by means of a printer in which the ink ribbon 34 is used, the ink image can be first heat-transferred by a thermal head of the printer and then the image-protective layer 33 can be heat-transferred on the ink image by the same thermal head. That is, after the ink layer 36 on the ink ribbon 34 is heat-transferred to form the ink image on the printing paper, the image-protective layer 33 on the ink ribbon 34 is heat-transferred with the specific transfer pattern on the printing paper. Thus, since the image-protective layer 33 is heat-transferred with the specific transfer pattern as described above, the surface conditions of the image-protective layer 33 formed on the ink image after the heat-transferring can be varied optionally.

The afore-mentioned ink layer 36 may be of either a sublimation heat-transfer recording type or a heat-fusion heat-transfer recording type, and produced by known methods for producing ink layers of conventional ink ribbons. For example, the ink layer of the sublimation heat-transfer recording type may be prepared by dispersing sublimable or heat-diffusible dyes in various resins, e.g., cellulose-based resins such as methyl cellulose, ethyl cellulose, hydroxyethyl cellulose, hydroxypropyl cellulose or cellulose acetate, vinyl-based resins such as polyvinyl alcohol, polyvinyl butyral, polyvinyl acetoacetal, polyvinyl acetate or polystyrene, various urethane resins, or the like.

Incidentally, in FIGS. 10A and 10B, in addition to the yellow (Y), magenta (M) and cyan (C) color layers, the ink layer 36 may further include a black color layer or any other optional color layers arranged in a in-line relation to the above-mentioned yellow, magenta and cyan color layers on the same plane. Alternatively, only one optional color (monocolor) layer can be formed as the ink layer 36.

In the case where the ink layer 36 of the sublimation heat-transfer recording type is provided, an image-receiving medium such as the printing paper may have an ink-receptor layer on a surface of the medium facing to the ink ribbon 34 so as to enable the ink image to be suitably formed thereon without any particular dye-receiving layer. Such an ink receptor layer may be formed from thermoplastic resins having a good dye affinity, such as polyester-based resins, cellulose ester-based resins, polycarbonate-based resins or polyvinyl chloride-based resins.

The methods of producing the transfer-type image-protective film 31 and the ink ribbon 34 are not particularly restricted. As the base films 32 and 35, there can be used base films for conventional ink ribbons, for example, polyester films, polyimide films or the like.

As the image-protective layer 33, any image-protecting materials conventionally known for this purpose can be used without limitation. As the image-protecting materials, there can be used thermoplastic resins such as polyester-based resins or cellulose ester-based resins. When selecting a material for the image-protective layer 33, it is necessary to assure that the ink serving for formation of the ink image does not ooze to an outer surface of the image-protective layer 33. Further, in the case where the image-protective layer 33 is formed from a thermoplastic resin, additives such as ultraviolet absorbers, light stabilizers or anti-oxidizing agents may be added thereto in order to enhance a keeping quality of the ink image transferred.

In the following, the present invention is described by way of examples in which image-transferred members were prepared according to the afore-mentioned image-forming methods.

EXAMPLES 11 to 15

First, apparatuses used in carrying out these Examples are explained. As an apparatus for heat-transferring an ink image and an image-protective layer by a thermal head, a video printer UP-D8800 manufactured by Sony Corp. was used. In addition, as an apparatus for producing image data and a transfer pattern for the image protective layer and transferring them to the video printer, a personal computer "POWER MACINTOSH 860A" manufactured by Apple Computer Inc. (hereinafter referred to merely as "computer") was used. The computer was coupled to the afore-mentioned video printer through an SCSI interface.

A software "ADOBE PHOTO SHOP" manufactured by Adobe Systems Inc., was used in the afore-mentioned computer to prepare data for gray solid image. The data for gray solid image was transferred to the video printer by which gray solid image was printed on a printing paper UPP-7041 manufactured by Sony Corp., using an ink ribbon UPC-8811 manufactured by Sony Corp.

Further, as the image-protective layer to be heat-transferred on the afore-mentioned gray solid image formed on the printing paper, a film piece cut from a transfer film attached to an ink ribbon UPR-7040 manufactured by Sony Corp. was used. The cut transfer film was adhered to an ink-applied portion of an ink ribbon UPC-8820 manufactured by Sony Corp. The afore-mentioned printing paper and the ink ribbon UPC-8820 on the ink-applied portion of which the cut transfer film is adhered were both set within the video printer.

Similarly, using the afore-mentioned computer and the software "ADOBE PHOTO SHOP" manufactured by Adobe Systems Inc., various transfer patterns (Examples 11 to 15) serving for heat-transferring the image-protective layer were prepared. The thus-prepared transfer patterns were transferred as image data to the afore-mentioned video printer, and the image-protective layer was heat-transferred at 150 dpi onto the printing paper on which the gray solid image was already formed.

As a result, as shown in Table 2 below, various surface conditions of the image-protective layer transferred and laminated over the gray solid image were obtained depending upon the transfer patterns used.

TABLE 2

| | Lamination of image-protective layer | Surface conditions of image-protective layer |
|---|---|---|
| Example 11 | No problem | Silk finish |
| Example 12 | No problem | Silk finish |
| Example 13 | No problem | Silk finish |
| Example 14 | No problem | Semi-gloss finish |
| Example 15 | No problem | Semi-gloss finish |

As is apparent from Table 2, since the image-protective layer was selectively heat-transferred by using the specific transfer patterns (Examples 11 to 15), the surface conditions of the image-protective layer transferred were varied depending upon the transfer pattern used. Accordingly, the user can obtain optional surface conditions of the image-protective layer transferred, so that the resultant image-transferred member can be subjected to various surface treatments as used for conventional silver salt photographs.

What is claimed is:

1. An image transfer ink ribbon comprising:

an elongate ribbon substrate having a longitudinal axis, a front major surface and an opposed rear major surface, a primer layer disposed on said front major surface, a plurality of repeating units disposed on the front major surface extending along the longitudinal axis, each repeating unit comprising at least one ink layer portion and an image protective layer portion each disposed on the primer layer, said image protective layer portion comprising a multilayer structure comprising a releaseable layer comprising a thermoplastic resin disposed on the primer layer, a release agent and optionally a surfactant selected from the group consisting of cationic surfactants, anionic surfactants, amphoteric surfactants and non-ionic surfactants; an intermediate adhesive layer disposed on said releaseable layer; and a low dye affinity top layer having a thickness of from about 0.3 to about 2.0 $\mu$m, said top layer comprising a thermoplastic resin selected from the group consisting of acrylic resins, polyvinyl acetoacetal resins, cellulose acetate resins, polystyrene resins, acrylonitrile resins, and polyvinyl butyral resins, a silica filler and optionally an additive selected from the group consisting of UV absorbers, light stabilizers and antioxidants.

2. An image-transfer ink ribbon as claimed in claim 1, further comprising a heat-resistant lubricating layer formed on the rear major surface.

3. An image transfer ink ribbon as defined in claim 2, wherein said heat resistant lubricating layer comprises a resin selected from cellulose acetate or polyvinyl butyral with a lubricant selected from silicone oil, waxes, fatty acids or phosphates.

4. An image-transfer ink ribbon as claimed in claim 1, wherein said repeating unit further comprises at least one sensor mark disposed on said primer layer.

5. An image-transfer ink ribbon as claimed in claim 1, wherein said at least one ink layer portion comprises three ink layer portions including a yellow ink layer portion, a magenta ink layer portion and a cyan ink layer potion.

6. An image-transfer ink ribbon as claimed in claim 1, wherein said at least one ink layer portion comprises four ink layer portions including a yellow ink layer portion, a magenta ink layer portion, a cyan ink layer portion and a black ink layer portion.

7. An image-transfer ink ribbon as claimed in claim 1, wherein said at least one ink layer portion comprises a black monocolor ink layer portion.

8. An image transfer ink ribbon as defined in claim 1, wherein said ribbon substrate comprises polyester or polyimide.

9. An image transfer ink ribbon as defined in claim 1, wherein said primer layer comprises a urethane-based resin, an acrylic resin or a polyester resin.

10. An image transfer ink ribbon as defined in claim 1, wherein said at least one ink layer portion includes an ink layer comprising a resin selected from the group consisting of cellulose-based resins, vinyl-based resins, polyester resins, acrylic resins and urethane-based resins.

11. An image transfer ink ribbon as defined in claim 1, wherein said releaseable layer comprises a thermoplastic resin selected from the group consisting of acrylic resins, cellulose ester-based resins, and polyvinyl butyral resins and said release agent is selected from silicone oil or a fluorine-based surfactant.

12. An image transfer ink ribbon as defined in claim 1, wherein said intermediate adhesive layer comprises an adhesive selected from the group consisting of polyester adhesives, cellulose ester adhesives, vinyl chloride-vinyl acetate copolymer adhesives, urethane adhesives and ethylene vinyl acetate adhesives.

* * * * *